United States Patent [19]

Jaulmes

[11] 3,993,030

[45] Nov. 23, 1976

[54] INJECTOR SUPPORT FOR DIRECT INJECTION ENGINES

[75] Inventor: Eric Jaulmes, Paris, France

[73] Assignee: Ateliers de la Motobecane, Pantin, France

[22] Filed: July 17, 1975

[21] Appl. No.: 596,673

[30] Foreign Application Priority Data

Aug. 6, 1974 France ..... 74.27242

[52] U.S. Cl. ..... 123/32 R; 123/73 B; 123/41.31

[51] Int. Cl.[2] ..... F02B 33/07

[58] Field of Search..... 123/32 JV, 32 ST, 32 R, 123/41.31, 41.52, 73 B, 73 C, 73 PP

[56] References Cited

UNITED STATES PATENTS

| | | | |
|---|---|---|---|
| 1,238,330 | 8/1917 | Peterson | 123/73 B |
| 3,334,617 | 8/1967 | Palkowsky | 123/41.31 X |
| 3,530,840 | 9/1970 | Freyn | 123/41.31 X |
| 3,881,454 | 5/1975 | Jaulmes | 123/73 B |

*Primary Examiner*—William R. Cline
*Attorney, Agent, or Firm*—Browdy and Neimark

[57] ABSTRACT

A fuel injection assembly has a fuel injector and an air intake manifold connected to a cylinder of an engine. The air intake manifold has an extension which extends between the injector and the cylinder wall to conduct heat coming from the cylinder wall away from the injector and into the air passing through the manifold.

7 Claims, 4 Drawing Figures

INJECTOR SUPPORT FOR DIRECT INJECTION ENGINES

FIELD OF THE INVENTION

The present invention relates to injector supports for direct injection engines and more particularly to such supports serving as heat shields between the injector and the engine wall.

BACKGROUND OF THE INVENTION

In direct injection engines a fuel injector is generally connected to an orifice provided in the cylinder wall or the cylinder head with which it is associated, and fastened by appropriate means. This arrangement has the disadvantage of allowing heating of the injector, thus producing fouling of the injector orifice and degrading engine performance.

SUMMARY OF THE INVENTION

The goal of the present invention is to eliminate these disadvantages by providing an injector support consisting of a metal sheet forming a heat shield between the injector and the engine wall, said sheet consisting of an extension of an air intake manifold. Using the air intake manifold as a cold source ensures heat dissipation in the heat shield, since the intake air, being fresh air, circulates continuously in the manifold when the engine is running and can thus remove heat independently of other cooling means.

In order to improve the insulation of the injector from the wall, the support incorporates a heat-insulating connector which is disposed between the assembly comprising the metal sheet and the air intake manifold on the one hand and the said wall on the other. This arrangement limits the heating of the injector by conduction.

To prevent the injector from being heated by conduction through its mounting means, the injector is mounted on its support by means of a clamp from which it is insulated by interposing a heat-insulating material, said clamp itself being connected to the support by suitable means.

In any case, the invention will be well defined by the description which follows, with reference to the schematic diagrams which are appended, showing as a non-limiting example, a preferred sample embodiment of an injector support according to the invention.

DETAILED DESCRIPTION OF PREFERRED EMBODIMENTS

Figure 1:
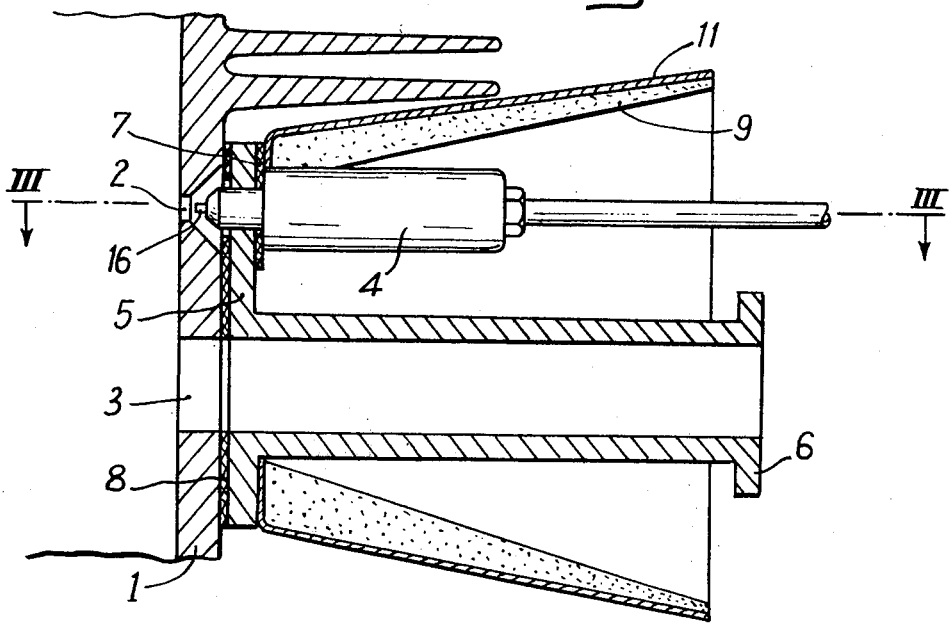
FIG. 1 is a schematic elevation in cross-section of an injector support according to the invention, mounted on the cylinder of a 2-stroke air-cooled engine.

As FIG. 1 shows, cylinder wall 1 comprises two orifices situated close together: fuel intake orifice 2 and air intake orifice 3. Fuel injector 4 is located opposite orifice 2. Heat shield 5 is an extension of air intake manifold 6 and is located between the cylinder wall and the injector, said heat shield forming a support for injector 4. The end of the air intake manifold 6 is located opposite orifice 3.

Flexible connector 7 is located between injector 4 and heat shield 5, and heat insulating connector 8 is located between cylinder wall 1 and the assembly comprising the heat shield and air intake manifold 6.

In another sample embodiment of the invention, connector 8 may be replaced by two different connectors, one disposed around the fuel intake orifice and the other around the air intake orifice.

This arrangement ensures that a considerable amount of the heat radiated by the cylinder to the injector is absorbed by heat shield 5 which transmits it to manifold 6. This heat is then dissipated in the intake air moving in the manifold.

The heat insulation of the injector can be further improved by limiting its heating by convection. The latter can be achieved by means of a heat-insulating material 9 which surrounds the assembly comprising the injector and the manifold. In addition, deflector 11 deflects the hot air from the cylinder wall.

Figure 2:
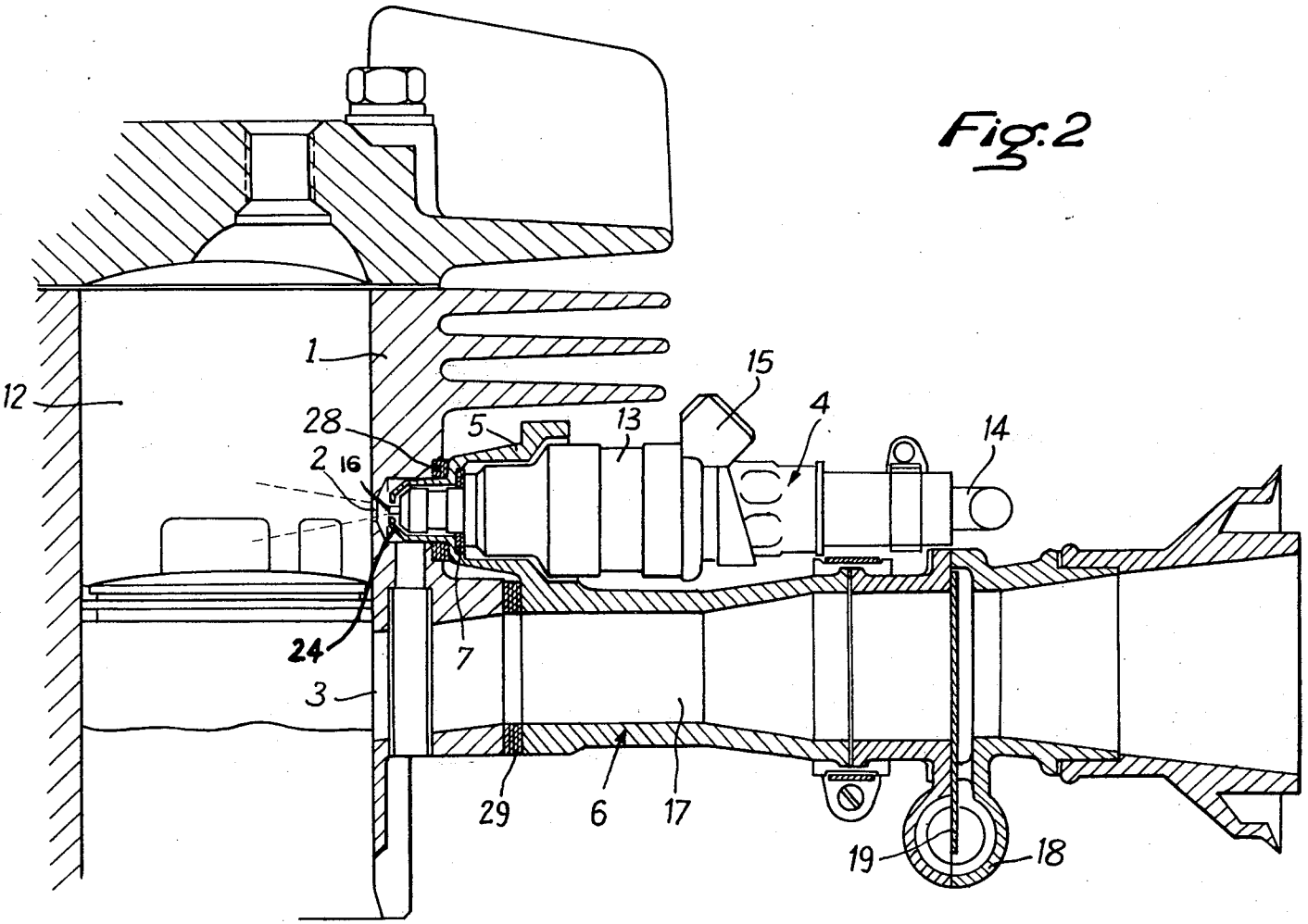
FIG. 2 is an elevation in cross-section of a preferred embodiment of the injector and its support.

FIG. 2 shows a preferred sample embodiment of the system described above.

Once again, there is wall 1 of cylinder 12 and orifices 2 and 3 for admitting fuel and air, respectively, said orifices being provided in said wall.

Injector 4 in known fashion comprises body 13, and fuel is supplied by tube 14. The injector also comprises connector 15 for electromagnetic control of needle 16.

Air intake manifold 6 comprises an essentially cylindrical part 17 and element 18 containing butterfly 19 to control air intake.

Heat shield 5 consists of an extension of cylindrical part 17 of the intake manifold. This extension comprises a metal sheet, having an essentially conical shape, into which injector 4 can be inserted. The injector is supported on the metal sheet by connector 7 and the metal sheet itself is supported on cylinder wall 1 by connector 28. Connector 28 is made of heat-insulating material.

Air intake manifold 6 is thermally insulated from the cylinder wall by connector 29.

The heat shield has an extension 24 partially covering the surface opposite the injector to prevent the hot gases emerging from within the cylinder from heating the injector.

Figure 3:
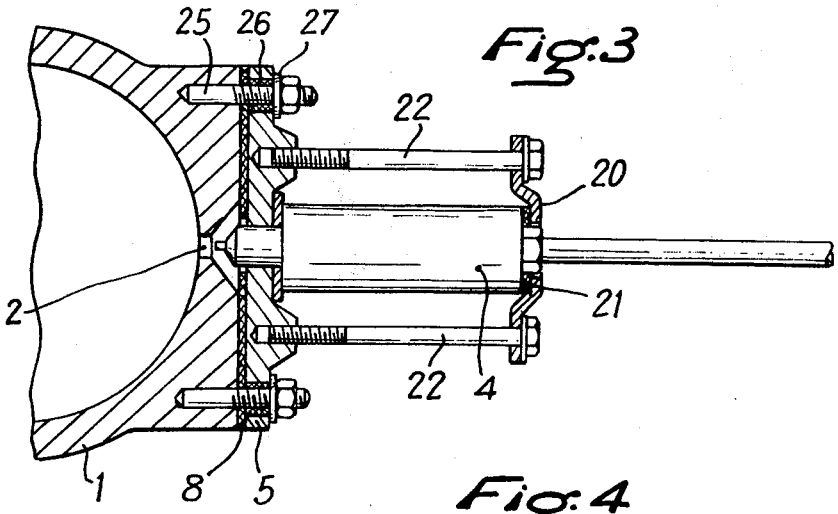
FIG. 3 is an elevation in cross-section along line III—III in FIG. 1.

FIG. 3 shows the system for mounting the injector on its support, comprising heat shield 5. Clamp 20 rests on the injector, and is heat-insulated from the latter by insulating washer 21. Clamp 20 is itself connected to the metal sheet by pins 22.

The manifold is mounted on the cylinder by means of pins 25 from which it is thermally insulated by sleeves 26 and washers 27 made of a heat-insulating material.

Thus, the injector and its support are totally thermally insulated from the cylinder wall.

Figure 4:
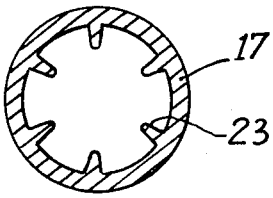
FIG. 4 is an elevation in cross-section of a version of the air intake manifold.

FIG. 4 shows a variation of the design of the interior of the intake manifold, allowing improved dissipation of the heat transmitted to said manifold by the heat shield. The essentially cylindrical part 17 of this manifold has fins 23 disposed longitudinally on its inside surface.

It will be obvious to those skilled in the art that various changes may be made without departing from the scope of the invention and the invention is not to be considered limited to what is shown in the drawings and described in the specification.

What is claimed:

1. A fuel injection assembly for a direct injection engine having orifices in the cylinder wall for receiving fuel and air, comprising:

a fuel injector aligned with one of the orifices in the cylinder wall;

an air intake manifold aligned with the other of the orifices in the cylinder wall; and a metal sheet between said injector and the cylinder wall and having an orifice aligned with the orifice in the cylinder wall, said metal sheet consisting of an extension of said air intake manifold and serving as a heat shield between said injector and the wall of the cylinder.

2. An injection assembly in accordance with claim 1, further including:

a heat insulating connector which is between the assembly comprising said metal sheet and said air intake manifold on the one hand and the cylinder wall on the other hand.

3. An injection assembly in accordance with claim 1, wherein said metal sheet consisting of an extension of said air intake manifold has essentially the general shape of a hollow cone, with said orifice at the apex thereof, aimed toward said cylinder, said cone being shaped to fit said injector thereinside.

4. An injection assembly in accordance with claim 1, further including clamp means, insulated from said injector by means of a heat-insulating material, for connecting said injector to said metal sheet.

5. An injection assembly in accordance with claim 1, wherein said air intake manifold has fin means disposed therewithin for releasing into the intake air the heat transmitted to said manifold by said metal sheet.

6. An injection assembly in accordance with claim 1, further including a heat-insulating material surrounding said injector and said air intake manifold.

7. An injection assembly in accordance with claim 1, further including deflector means for deflecting the air heated in the vicinity of the cylinder, said deflector means being disposed around said injector and said air intake manifold.

* * * * *